US005489393A

United States Patent [19]

Connor et al.

[11] Patent Number: 5,489,393

[45] Date of Patent: Feb. 6, 1996

[54] HIGH SUDSING DETERGENT WITH N-ALKOXY POLYHYDROXY FATTY ACID AMIDE AND SECONDARY CARBOXYLATE SURFACTANTS

[75] Inventors: Daniel S. Connor; Jeffrey J. Scheibel, both of Cincinnati; Yi-Chang Fu, Wyoming, all of Ohio

[73] Assignee: The Procter & Gamble Company, Cincinnati, Ohio

[21] Appl. No.: 278,855

[22] Filed: Jul. 26, 1994

Related U.S. Application Data

[63] Continuation-in-part of Ser. No. 118,867, Sep. 9, 1993, abandoned.

[51] Int. Cl.[6] ..... C11D 17/00; C11D 3/07

[52] U.S. Cl. ..... 252/134; 252/121; 252/550; 252/554; 252/558; 252/523; 252/529; 252/174.17

[58] Field of Search ..... 252/108, 117, 252/121, 558, 554, 550, 523, 525, 529, 174.17, 134

[56] References Cited

U.S. PATENT DOCUMENTS

| | | | |
|---|---|---|---|
| 3,312,627 | 4/1967 | Hooker | 252/152 |
| 3,607,761 | 9/1971 | Feighner et al. | 252/108 |
| 3,654,166 | 4/1972 | Eckert et al. | 252/117 |
| 3,676,338 | 7/1972 | Fries et al. | 252/8.75 |
| 3,764,531 | 10/1973 | Eckert et al. | 252/8.8 |
| 3,793,214 | 2/1974 | O'Neill et al. | 252/117 |
| 3,916,003 | 10/1975 | Suzuki et al. | 260/404 |
| 5,174,927 | 12/1992 | Honsa | 252/543 |
| 5,188,769 | 2/1993 | Connor et al. | 252/548 |
| 5,194,639 | 3/1993 | Connor et al. | 554/66 |
| 5,244,593 | 9/1993 | Roselle et al. | 252/99 |
| 5,254,281 | 10/1993 | Pichardo et al. | 252/108 |
| 5,283,009 | 2/1994 | Speckman et al. | 252/548 |
| 5,318,728 | 6/1994 | Surutzidis et al. | 252/548 |
| 5,332,528 | 7/1994 | Pan et al. | 252/548 |

FOREIGN PATENT DOCUMENTS

| | | | |
|---|---|---|---|
| 5 9161-498-a | 9/1984 | Japan | C11D 9/26 |
| 3-246265 | 11/1991 | Japan | C07C 233/18 |
| 04323298 | 11/1992 | Japan | C11D 3/20 |
| WO92/06150 | 4/1992 | WIPO | C11D 3/00 |
| WO92/06171 | 4/1992 | WIPO | C11D 17/00 |
| WO92/05764 | 4/1992 | WIPO | A61K 7/06 |
| WO92/06151 | 4/1992 | WIPO | C11D 1/52 |
| WO92/06157 | 4/1992 | WIPO | C11D 1/65 |
| WO94/12608 | 6/1994 | WIPO | C11D 10/04 |

OTHER PUBLICATIONS

PCT Search Report dated Aug. 2, 1995.

*Primary Examiner*—Asok Pal
*Assistant Examiner*—Patricia L. Hailey
*Attorney, Agent, or Firm*—Jerry J. Yetter; Jacobus C. Rasser

[57] ABSTRACT

High sudsing detergent compositions comprising N-alkoxy polyhydroxy fatty acid amides are provided by the addition of secondary carboxylate surfactants. Thus, cocofatty acid N-(3-methoxypropyl) glucamide is used in liquid, granular or bar compositions in combination with conventional detergent ingredients and secondary fatty acids such as 2-methyl undecanoic acid. The compositions exhibit high, relatively persistent suds and high emulsifying and cleaning properties, especially with respect to greasy soils of the type commonly found on eating utensils and in food stains on fabrics.

11 Claims, No Drawings

HIGH SUDSING DETERGENT WITH N-ALKOXY POLYHYDROXY FATTY ACID AMIDE AND SECONDARY CARBOXYLATE SURFACTANTS

This is a continuation-in-part of application Ser. No. 08/118,867, filed on Sep. 9. 1993, now abandoned.

FIELD OF THE INVENTION

The present invention relates to high-sudsing detergent compositions which are especially useful in hand dishwashing operations.

BACKGROUND OF THE INVENTION

The formulation of effective detergent compositions presents a considerable challenge. Effective compositions are required to remove a variety of soils and stains from diverse substrates. In particular, the removal of greasy/oily soils quickly and efficiently can be problematic. For example, the removal of greasy food residues from dishware in hand dishwashing operations has become a particular challenge to the formulator. Modern dishwashing compositions are, in the main, formulated as aqueous liquids; accordingly, water-stable ingredients must be used. Moreover, such compositions come into prolonged contact with skin; therefore, they must be mild. Yet, mildness is difficult to achieve in an effective dishwashing product, since products which remove grease from dishware may also tend to remove the natural skin oils from the user's hands.

Various means have been suggested to enhance the grease and oil removal performance of detergent compositions. Grease-cutting nonionic surfactants have been employed, but some of these may be irritating to biological membranes. Some suggestions have been made to use nonconventional detergent surfactants in liquid compositions. Indeed, while a review of the literature would seem to indicate that a wide selection of surfactants is available to the detergent manufacturer, the reality is that many such materials are specialty chemicals which are not suitable in low unit cost items such as home-use detergent compositions. The fact remains that most home-use detergents still comprise one or more of the conventional ethoxylated nonionic and sulfated or sulfonated anionic surfactants, presumably due to economic considerations.

The challenge to the detergent manufacturer seeking improved grease/oil removal has been increased by various environmental factors. For example, some nonbiodegradable ingredients have fallen into disfavor. Effective phosphate builders have been banned by legislation in many countries. Moreover, many surfactants are often available only from nonrenewable resources such as petrochemicals. Accordingly, the detergent formulator is quite limited in the selection of surfactants which are effective cleaners, biodegradable and, to the extent possible, available from renewable resources such as natural fats and oils, rather than petrochemicals.

Considerable attention has lately been directed to nonionic surfactants which can be prepared using mainly renewable resources, such as fatty esters and sugars. One such class of surfactants includes the polyhydroxy fatty acid amides. Moreover, the combination of such nonionic surfactants with conventional anionic surfactants such as the alkyl sulfates, alkyl benzene sulfonates, alkyl ether sulfates, and the like has also been studied. Indeed, substantial success in the formulation of detergent compositions has recently been achieved using the N-alkyl polyhydroxy fatty acid amide surfactants. However, even these superior surfactants do suffer from some drawbacks. For example, their solubility is not as high as might be desired for optimal formulations. At high concentrations in water they can be difficult to handle and pump, so additives must be employed in manufacturing plants to control their viscosity. While quite compatible with anionic suffactants, their compatibility can be diminished substantially in the presence of water hardness cations. And, of course, there is always the objective to find new surfactants which lower interfacial tensions to an even greater degree than the N-alkyl polyhydroxy fatty acid amides in order to increase cleaning performance.

It has now been determined that the N-alkoxy polyhydroxy fatty acid amide surfactants surprisingly differ from their counterpart N-alkyl polyhydroxy fatty acid amide surfactants in several important and unexpected ways which are of considerable benefit to detergent formulators. The alkoxy-substituted polyhydroxy fatty acid amide compounds herein substantially reduce interfacial tensions, and thus provide for high cleaning performance in detergent compositions, even at low wash temperatures. The compounds herein exhibit more rapid dissolution in water than the corresponding N-alkyl polyhydroxy fatty acid amide surfactants, even at low temperatures (5°–30° C.). The high solubility of the compounds herein allows them to be formulated as modern concentrated detergent compositions. The compounds herein can be easily prepared as low viscosity, pumpable solutions (or melts) at concentrations as high as 70–100%, which allows them to be easily handled in the manufacturing plant. Moreover, the high solubility of the compounds herein makes them more compatible with calcium and magnesium cations, even in relatively concentrated compositions.

While it can thus be seen that the N-alkoxy polyhydroxy fatty acid amides provide substantial benefits, in the main they do tend to exhibit somewhat lower sudsing than their N-alkyl counterpart suffactants. However, users of the so-called "light-duty liquid" hand dishwashing compositions tend to equate product performance with suds height and persistence. Accordingly, modestly sudsing hand dishwashing compositions, while perhaps effective for their intended use, may be rejected by consumers based on their sub-optimal sudsing profile.

Succinctly stated, the invention herein is based on the discovery that use of specially selected "soap" materials can substantially enhance the grease and oil removal properties of detergent compositions which contain N-alkoxy polyhydroxy fatty acid amides. While not intending to be limited by theory, it appears that the inclusion of such soap materials into the present compositions substantially enhances their ability to rapidly lower the interfacial tension of aqueous washing liquors with greasy and oily soils. This substantial reduction of interfacial tension leads to what might be termed "spontaneous emulsification" of greasy and oily soils, thereby speeding removal from soiled surfaces and inhibiting the redeposition of the soils onto substrates. This phenomenon is particularly noteworthy in the case of hand dishwashing operations with greasy dishware.

It has further been determined that the use of common linear soaps does not provide optimum high sudsing, as is desired by the users of such compositions for hand dishwashing. Indeed, linear soaps are often used to diminish suds levels in certain European fabric laundering detergents; accordingly, the use of conventional linear soaps in the current compositions is sub-optimal, inasmuch as sudsing can suffer. Moreover, some soaps tend to provide their best grease cutting performance at pH's in the alkaline range, whereas it is much more desirable to have hand dishwashing compositions formulated at near-neutrality.

By the present invention it has been determined that certain soaps, e.g., secondary alkyl carboxylates, not only provide a desired additional lowering of interfacial tension, with its attendant increase in grease removal performance, but also, and importantly, allow the formulation of reasonably high sudsing liquid compositions which contain the aforesaid desirable N-alkoxy- polyhydroxy fatty acid amide surfactants, and which are stable and homogeneous. The inclusion of calcium ions in such compositions still further enhances the lowering of interfacial tension, and thus still further enhances grease removal performance. Moreover, the sudsing of such compositions can be increased even further by the addition of magnesium ions. These special benefits can be achieved at neutral pH, which enhances mildness and avoids the need for costly buffering chemicals. The overall unexpected improvements in performance and aesthetic qualities, especially sudsing, are described in more detail hereinafter.

BACKGROUND ART

Japanese Kokai HEI 3[1991]-246265 Osamu Tachizawa, U.S. Pat. Nos. 5,194,639, 5,174,927 and 5,188,769 and WO 9,206,171, 9,206,151, 9,206,150 and 9,205,764 relate to various polyhydroxy fatty acid amide surfactants and uses thereof.

SUMMARY OF THE INVENTION

The present invention relates to detergent compositions with high sudsing characteristics, comprising:

(a) at least about 1%, preferably from about 5% to about 55%, by weight of an amide nonionic surfactant of the formula

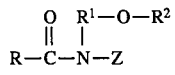

wherein R is a $C_7$–$C_{17}$, preferably $C_{11}$–$C_{13}$, hydrocarbyl moiety, $R^1$ is a $C_2$–$C_4$, preferably $C_2$–$C_3$, hydrocarbyl moiety, $R^2$ is a $C_1$–$C_3$ hydrocarbyl or oxyhydrocarbyl moiety, most preferably methyl, and Z is a polyhydroxy hydrocarbyl unit having a linear chain with at least two, preferably at least three, hydroxyls directly connected to the chain; and (b) at least about 1%, preferably from about 5% to about 35%, by weight of a secondary soap.

In a preferred mode, the compositions are those wherein substituent Z of nonionic surfactant (a) is derived from a reducing sugar, especially a reducing sugar which is a member selected from the group consisting of glucose, fructose, maltose, xylose and mixtures thereof For high sudsing R, $R^1$ and $R^2$ on surfactant (a), R is preferably 7–13, $R^1$ is preferably ethylene or propylene (ethylene compounds tend to be higher sudsing than propylene) and $R^2$ is preferably methyl. For best cleaning, R is preferably $C_{11-C13}$.

Preferred secondary soaps (b) include members selected from the group consisting of secondary carboxyl materials of the formulae:

(i) $R^3H(R^4)COOM$, wherein $R^3$ and $R^4$ are each hydrocarbyl or hydrocarbylene units with the sum of $R^3$ and $R^4$ being in the range from about 7 to about 16 carbon atoms and M is H or a water solubilizing cation;

(ii) $R^5R^6COOM$ wherein $R^5$ is $C_7$–$C_{10}$ alkyl or alkenyl, $R^6$ is a hydrocarbyl ring structure and M is H or a water-solubilizing cation; and (iii) $CH_3(CHR^7)_k$—$(CH_2)_m$—$(CHR^7)_n$—CH(COOM)—$(CHR^7)_o$—$(CH_2)_p$— $(CHR^7)_q$—$CH_3$ wherein each $R^7$ is $C_1$–$C_4$ alkyl, wherein k, n, o, and q are integers in the range of 0–2 and m and p are integers in the range of 0.8, and wherein the total number of carbon atoms is about 10 to about 18, and wherein M is H or a water-solubilizing cation.

Highly preferred examples of said secondary soaps include the water-soluble salt of secondary carboxyl materials which are members selected from the group consisting of 2-methyl-1-undecanoic acid, 2-ethyl-1-decanoic acid, 2-propyl-1-nonanoic acid, 2-butyl-1-otanoic acid, 2-pentyl-1-heptanoic acid, and mixtures thereof.

The compositions herein will optionally, but preferably, additionally comprise at least about 1% by weight of a sulfated or sulfonated anionic surfactant.

Especially high sudsing, high grease removal versions of the compositions herein may also comprise at least about 1% by weight of an additional surfactant which is a member selected from the group consisting of alkoxy carboxylate, amine oxide, betaine and sultaine surfactants, and mixtures thereof. Such surfactants may be used alone, or in combination with sulfated or sulfonated surfactants.

In yet another mode, the compositions herein will additionally comprise at least about 0.05% by weight of calcium ions, magnesium ions, or mixtures thereof, to still further enhance grease removal and high sudsing performance.

The invention also encompasses a method for hand cleaning of dishware (including eating utensils, cooking utensils and the like) comprising contacting said dishware with an aqueous medium containing at least about 100 ppm, preferably 200 ppm–15,000 ppm, of the aforesaid compositions, preferably with agitation. The invention also encompasses a method for cleaning fabrics, especially hand-washing, by agitating said fabrics in the foregoing manner.

All percentages, ratios and proportions herein are by weight, unless otherwise specified. All documents cited are incorporated herein by reference.

DETAILED DESCRIPTION OF THE INVENTION

The N-alkoxy and N-aryloxy polyhydroxy fatty acid amide surfactants used in the practice of this invention are quite different from traditional ethoxylated nonionics, due to the use of a linear polyhydroxy chain as the hydrophilic group instead of the ethoxylation chain. Conventional ethoxylated nonionic surfactants have cloud points with the less hydrophilic ether linkages. They become less soluble, more surface active and better performing as temperature increases, due to thermally induced randomness of the ethoxylation chain. When the temperature gets lower, ethoxylated nonionics become more soluble by forming micelles at very low o concentration and are less surface active, and lower performing, especially when washing time is short.

In contrast, the polyhydroxy fatty acid amide surfactants have polyhydroxyl groups which are strongly hydrated and do not exhibit cloud point behavior. It has been discovered that they exhibit Krafft point behavior with increasing temperature and thus higher solubility at elevated temperatures. They also have critical micelle concentrations similar to anionic surfactants, and it has been surprisingly discovered that they clean like anionics.

Moreover, the polyhydroxy fatty acid amides herein are different from the alkyl polyglycosides (APG) which comprise another class of polyhydroxyl nonionic surfactants. While not intending to be limited by theory, it is believed that the difference is in the linear polyhydroxyl chain of the polyhydroxy fatty acid amides vs. the cyclic APG chain which prevents close packing at interfaces for effective cleaning.

With respect to the N-alkoxy and N-aryloxy polyhydroxy fatty acid amides, such surfactants have now been found to have a much wider temperature usage profile than their N-alkyl counterparts, and they require no or little cosurfactants for solubility at temperatures as low as 5° C. Such surfactants also provide easier processing due to their lower melting points. It has now further been discovered that these surfactants are biodegradable.

As is well-known to formulators, most laundry detergents are formulated with mainly anionic surfactants, with nonionics sometimes being used for grease/oil removal. Since it is well known that nonionic surfactants are far better for enzymes, polymers, soil suspension and skin mildness, it would be preferred that laundry detergents use more nonionic surfactants. Unfortunately, traditional nonionics do not clean well enough in cooler water with short washing times.

It has now also been discovered that the N-alkoxy and N-aryloxy polyhydroxy fatty acid amide surfactants herein provide additional benefits over conventional nonionics, as follows:

a. Much enhanced stability and effectiveness of new enzymes, like cellulase and lipase, and improved performance of soil release polymers;

b. Much less dye bleeding from colored fabrics, with less dye transfer onto whites;

c. Better water hardness tolerance;

d. Better greasy soil suspension with less redeposition onto fabrics;

e. The ability to incorporate higher levels of surfactants not only into Heavy Duty Liquid Detergents (HDL's), but also into Heavy Duty Granules (HDG's) with the new solid surfactants herein; and f. The ability to formulate stable, high performance "High Nonionic/Low Anionic" HDL and HDG compositions.

N-Alkoxy Polyhydroxy Fatty Acid Amides

The N-alkoxy polyhydroxy fatty acid amide surfactants used herein comprise amides of the formula:

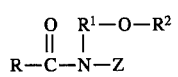

wherein: R is $C_7$–$C_{17}$ hydrocarbyl, including straight-chain (preferred), branched-chain alkyl and alkenyl, as well as substituted alkyl and alkenyl, e.g., 12-hydroxyoleic, or mixtures thereof; $R^l$ is a linear or branched $C_2$–$C_4$ hydrocarbyl, preferably —$CH_2CH_2$—, —$CH_2CH_2CH_2$— and $R^2$ is a linear or branched $C_1$–$C_3$ hydrocarbyl or oxy-hydrocarbyl; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$13 $CH_2$ OH, —$CH_2$—$(CHOH)_2(CHOR')(CHOH)$—$CH_2OH$, where n is an integer from 1 to 5, inclusive, and R' is H or a cyclic mono- or poly- saccharide, and alkoxylated derivatives thereof. Most preferred are glycityls wherein n is 4, particularly —$CH_2$—$(CHOH)_4$— $CH_2OH$.

In compounds of the above formula, nonlimiting examples of the amine substituent group —$R^1$—O—$R^2$ can be, for example: 2-methoxyethyl-, 3-methoxypropyl-, 2-ethoxyethyl-, 3-ethoxypropyl-, 2-methoxypropyl, 2-isopropoxyethyl-, 3-isopropoxypropyl-, tetrahydrofurfuryl-, 3-[2-methoxyethoxy]propyl-, and $CH_3O$—$CH_2CH(CH_3)$—.

R—CO—N< can be, for example, cocamide, lauramide, oleamide, myristamide, capricamide, ricinolamide, etc.

While the synthesis of N-alkoxy polyhydroxy fatty acid amides can prospectively be conducted using various processes, contamination with cyclized by-products and other colored materials may be problematic. As an overall proposition, the synthesis method for these surfactants comprises reacting the appropriate N-alkoxy or N-aryloxy-substituted aminopolyols with, preferably, fatty acid methyl esters either with or without a solvent using an alkoxide catalyst (e.g., sodium methoxide or the sodium salts of glycerin or propylene glycol) at temperatures of about 85° C. to provide products having desirable low levels (preferably, less than about 10%) of cyclized or ester amide by-products and also with improved color and improved color stability, e.g., Gardner Colors below about 4, preferably between 0 and 2. If desired, any unreacted N-alkoxy or N-aryloxy amino polyol remaining in the product can be acylated with an acid anhydride, e.g., acetic anhydride, maleic anhydride, or the like, at 50° C.–85° C., in water to minimize the overall level of such residual amines in the product. Residual sources of straight-chain primary fatty acids, which can suppress suds, can be depleted by reaction with, for example, monoethanolamine at 50° C.–85° C.

If desired, the water solubility of the solid N-alkoxy polyhydroxy fatty acid amide surfactants herein can be enhanced by quick cooling from a melt. While not intending to be limited by theory, it appears that such quick cooling re-solidifies the melt into a metastable solid which is more soluble in water than the pure crystalline form of the N-alkoxy polyhydroxy fatty acid amide. Such quick cooling can be accomplished by any convenient means, such as by use of chilled (0° C.–10° C.) rollers, by casting the melt onto a chilled surface such as a chilled steel plate, by means of refrigerant coils immersed in the melt, or the like.

By "cyclized by-products" herein is meant the undesirable reaction by-products of the primary reaction wherein it appears that the multiple hydroxyl groups in the polyhydroxy fatty acid amides can form ring structures. It will be appreciated by those skilled in the chemical arts that the preparation of the polyhydroxy fatty acid amides herein using the di- and higher saccharides such as maltose will result in the formation of polyhydroxy fatty acid amides wherein linear substituent Z (which contains multiple hydroxy substituents) is naturally "capped" by a polyhydroxy ring structure. Such materials are not cyclized by-products, as defined herein.

Usage levels of the aforesaid N-alkoxy- or N-aryloxy-polyhydroxy fatty acid amides herein typically range from about 5% to about 55%, preferably from about 8% to about 20%, by weight of the compositions herein.

The following illustrates the syntheses in more detail.

EXAMPLE I

Preparation of N-(2-methoxyethyl)glucamine

N-(2-methoxyethyl)glucosylamine (sugar adduct) is prepared starting with 1728.26 g of 50 wt. % 2-methoxyethylamine in water (11.5 moles, 1.1 mole equivalent of 2-methoxyethylamine) placed under an $N_2$ blanket at 10° C. 2768.57 grams of 50 wt. % glucose in water (10.46 moles, 1 mole equivalent of glucose), which is degassed with $N_2$, is added slowly, with mixing, to the methoxyethylamine solution keeping the temperature below 10° C. The solution is mixed for about 40 minutes after glucose addition is complete. It can be used immediately or stored 0° C.–5° C. for several days.

About 278 g (~15 wt. % based on amount of glucose used) of Raney Ni (Activated Metals & Chemicals, Inc. product A-5000) is loaded into a 2 gallon reactor (316 stainless steel baffled autoclave with DISPERSIMAX hollow shaft multi-blade impeller) with 4L of water. The reactor is heated, with stirring, to 130° C. at about 1500 psig hydrogen for 30 minutes. The reactor is then cooled to room temperature and the water removed to 10% of the reactor volume under hydrogen pressure using an internal dip tube.

The reactor is vented and the sugar adduct is loaded into the reactor at ambient hydrogen pressure. The reactor is then purged twice with hydrogen. Stirring is begun, the reactor is heated to 50° C., pressurized to about 1200 psig hydrogen and these conditions are held for about 2 hours. The temperature is then raised to 60° C. for 10 minutes, 70° C. for 5 minutes, 80° C. for 5 minutes, 90° C. for 10 minutes, and finally 100° C. for 25 minutes.

The reactor is then cooled to 50° C. and the reaction solution is removed from the reactor under hydrogen pressure via an internal dip tube and through a filter in closed communication with the reactor. Filtering product under hydrogen pressure allows removal of any nickel particles without nickel dissolution.

Solid N-(2-methoxyethyl)glucamine is recovered by evaporation of water and excess 2-methoxyethylamine. The product purity is approximately 90% by G.C. Sorbitol is the major impurity at about 10%. The N-(2-methoxyethyl)glucamine can be used as is or purified to greater than 99% by recrystallization from methanol.

EXAMPLE II

Preparation of $C_{12}$-N-(2-Methoxyethyl)glucamide

N-(2-methoxyethyl)glucamine, 1195 g (5.0 mole; prepared according to Example I) is melted at 135° C. under nitrogen. A vacuum is pulled to 30 inches (762 mm) Hg for 15 minutes to remove gases and moisture. Propylene glycol, 21.1 g (0.28 mole) and fatty acid methyl ester (Procter & Gamble CE 1295 methyl ester) 1097 (5.1 mole) are added to the preheated amine. Immediately following, 25% sodium methoxide, 54 g (0.25 mole) is added in halves.

Reactants weight: 2367.1 g

Theoretical MeOH generated: (5.0×32)+(0.75×54)+(0.24×32)=208.5 g

Theory product: FW 422 2110 g 5.0 mole

The reaction mixture is homogeneous within 2 minutes of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 10 inches (254 mm) Hg. At 180 minutes, another GC sample is taken and the vacuum has been increased to 16 inches (406 nun) Hg. After 180 minutes at 85° C., the remaining weight of methanol in the reaction is 4.1% based on the following calculation: 2251 g current reaction wt.— (2367.1 g reactants wt.—208.5 g theoretical MeOH)/2251 g=4.1% MeOH remaining in the reaction. After 180 minutes, the reaction is bottled and allowed to solidify at least overnight to yield the desired product.

EXAMPLE III

Preparation of N-(3-methoxypropyl)glucamine

About 300 g (about 15 wt. % based on amount of glucose used) of Raney Ni (Activated Metals & Chemicals, Inc. product A-5000 or A-5200) is contained in a 2 gallon reactor (316 stainless steel baffled autoclave with DISPERSIMAX hollow shaft multi-blade impeller) pressurized to about 300 psig with hydrogen at room temperature. The nickel bed is covered with water taking up about 10% of the reactor volume.

1764.8 g (19.8 moles, 1.78 mole equivalent) of 3-methoxypropylamine (99%) is maintained in a separate reservoir which is in closed communication with the reactor. The reservoir is pressurized to about 100 psig with nitrogen. 4000 g of 50 wt. % glucose in water (11.1 moles, 1 mole equivalent of glucose) is maintained in a second separate reservoir which is also in closed communication with the reactor and is also pressurized to about 100 psig with nitrogen.

The 3-methoxypropylamine is loaded into the reactor from the reservoir using a high pressure pump. Once all the 3-methoxypropylamine is loaded into the reactor, stirring is begun and the reactor heated to 60° C. and pressurized to about 800 psig hydrogen. The reactor is stirred at 60° C. and about 800 psig hydrogen for about 1 hour.

The glucose solution is then loaded into the reactor from the reservoir using a high pressure pump similar to the amine pump above. However, the pumping rate on the glucose pump can be varied and on this particular run, it is set to load the glucose in about 1 hour. Once all the glucose has been loaded into the reactor, the pressure is boosted to about 1500 psig hydrogen and the temperature maintained at 60° C. for about 1 hour. The temperature is then raised to 70° C. for 10 minutes, 80° C. for 5 minutes, 90° C. for 5 minutes, and finally 100° C. for 15 minutes.

The reactor is then cooled to 60° C. and the reaction solution is removed from the reactor under hydrogen pressure via an internal dip tube and through a filter in closed communication with the reactor. Filtering under hydrogen pressure allows removal of any nickel particles without nickel dissolution.

Solid N-(3-methoxypropyl)glucamine is recovered by evaporation of water and excess 3-methoxypropylamine. The product purity is approximately 90% by G.C. Sorbitol is the major impurity at about 3%. The N-(3-methoxypropyl)glucamine can be used as is or purified to greater than 99% by recrystallization from methanol.

EXAMPLE IV

Preparation of $C_{12}$-N-(3-Methoxypropyl)glucamide

N-(3-methoxypropyl)glucamine, 1265 g (5.0 mole prepared according to Example III) is melted at 140° C. under nitrogen. A vacuum is pulled to 25 inches (635 mm) Hg for 10 minutes to remove gases and moisture. Propylene glycol, 109 g (1.43 mole) and CE 1295 methyl ester, 1097 (5.1 mole) are added to the preheated amine. Immediately following, 25% sodium methoxide, 54 g (0.25 mole) is added in halves.

Reactants weight: 2525 g

Theoretical MeOH generated: (5.0×32)+(0.75×54)+(0.24×32)= 208.5 g

Theory product: FW 436 2180 g 5.0 mole

The reaction mixture is homogeneous within 1 minute of adding the catalyst. It is cooled with warm $H_2O$ to 85° C. and allowed to reflux in a 5-liter, 4-neck round bottom flask equipped with a heating mantle, Trubore stirrer with Teflon paddle, gas inlet and outlet, Thermowatch, condenser, and air drive motor. When catalyst is added, time=0. At 60 minutes, a GC sample is taken and a vacuum of 7 inches (178 mm) Hg is started to remove methanol. At 120 minutes, another GC sample is taken and the vacuum has been increased to 12 inches (305 mm) Hg. At 180 minutes, another GC sample is taken and the vacuum has been increased to 20 inches (508 mm) Hg. After 180 minutes at 85° C., the remaining weight of methanol in the reaction is 2.9% based on the following calculation: 2386 g current reaction wt.— (2525 g reactants wt.—208.5 g theoretical MeOH)/2386 g=2.9% MeOH remaining in the reaction. After 180 minutes, the reaction is bottled and allowed to solidify at least overnight to yield the desired product.

The foregoing reaction can be conducted using the methyl esters of mixed oils, including palm, palm kernel oil, coconut oil and the like.

Glyceride Process

If desired, the N-alkoxy and N-aryloxy surfactants used herein may be made directly from natural fats and oils rather than fatty acid methyl esters. This so-called "glyceride process" results in a product which is substantially free of conventional fatty acids such as lauric, myristic and the like, which are capable of precipitating as calcium soaps under wash conditions, thus resulting in unwanted residues on fabrics or filming/spotting in, for example, hard surface cleaners and dishware cleaners.

Triglyceride Reactant

The reactant used in the glyceride process can be any of the well-known fats and oils, such as those conventionally used as foodstuffs or as fatty acid sources. Non-limiting examples include: CRISCO oil; palm oil; palm kernel oil; corn oil; cottonseed oil; soybean oil; tallow; lard; canola oil; rapeseed oil; peanut oil; tung oil; olive oil; menhaden oil; coconut oil; castor oil; sunflower seed oil; and the corresponding "hardened", i.e., hydrogenated oils. If desired, low molecular weight or volatile materials can be removed from the oils by steamstripping, vacuum stripping, treatment with carbon or "bleaching earths" (diatomaceous earth), or cold tempering to further minimize the presence of malodorous by-products in the surfactants prepared by the glyceride process.

N-substituted Polyhydroxy Amine Reactant

The N-alkyl, N-alkoxy or N-aryloxy polyhydroxy amines used in the process are commercially available, or can be prepared by reacting the corresponding N-substituted amine with a reducing sugar, typically in the presence of hydrogen and a nickel catalyst as disclosed in the art. Non-limiting examples of such materials include: N-(3-methoxypropyl) glucamine; N-(2-methoxyethyl) glucamine; and the like.

Catalyst

The preferred catalysts for use in the glyceride process are the alkali metal salts of polyhydroxy alcohols having at least two hydroxyl groups. The sodium (preferred), potassium or lithium salts may be used. The alkali metal salts of monohydric alcohols (e.g., sodium methoxide, sodium ethoxide, etc.) could be used, but are not preferred because of the formation of malodorous short-chain methyl esters, and the like. Rather, it has been found to be advantageous to use the alkali metal salts of polyhydroxy alcohols to avoid such problems. Typical, non-limiting examples of such catalysts include sodium glycolate, sodium glycerate and propylene glycolates such as sodium propyleneglycolate (both 1,3- and 1,2-glycolates can be used; the 1,2-isomer is preferred), and 2-methyl-1,3-propyleneglycolate. Sodium salts of NEODOL-type ethoxylated alcohols can also be used.

Reaction Medium

The glyceride process is preferably not conducted in the presence of a monohydric alcohol solvent such as methanol, because malodorous acid esters may form. However, it is preferred to conduct the reaction in the presence of a material such as an alkoxylated alcohol or alkoxylated alkyl phenol of the surfactant type which acts as a phase transfer agent to provide a substantially homogeneous reaction mixture of the polyhydroxy amine and oil (triglyceride) reactants. Typical examples of such materials include: NEODOL 10-8, NEODOL 23-3, NEODOL 25-12 AND NEODOL 11-9. Pre-formed quantities of the N-alkoxy and N-aryloxy polyhydroxy fatty acid amides, themselves, can also be used for this purpose. In a typical mode, the reaction medium will comprise from about 10% to about 25% by weight of the total reactants.

Reaction Conditions

The glyceride process is preferably conducted in the melt. N-substituted polyhydroxy amine, the phase transfer agent (preferred NEODOL) and any desired glyceride oil are co-melted at 120° C.–140° C. under vacuum for about 30 minutes. The catalyst (preferably, sodium propylene glycolate) at about 5 mole % relative to the polyhydroxy amine is added to the reaction mixture. The reaction quickly becomes homogeneous. The reaction mixture is immediately cooled to about 85° C. At this point, the reaction is nearly complete. The reaction mixture is held under vacuum for an additional hour and is substantially complete at this point.

In an alternate mode, the NEODOL, oil, catalyst and polyhydroxy amine are mixed at room temperature. The mixture is heated to 85° C.–90° C., under vacuum. The reaction becomes clear (homogeneous) in about 75 minutes. The reaction mixture is maintained at about 90° C., under vacuum, for an additional two hours. At this point the reaction is complete.

In the glyceride process, the mole ratio of triglyceride oil:polyhydroxy amine is typically in the range of about 1:2 to 1:3.1.

Product Work-Up

The product of the glyceride process will contain the polyhydroxy fatty acid amide surfactant and glycerol. The glycerol may be removed by distillation, if desired. If desired, the water solubility of the solid polyhydroxy fatty acid amide surfactants can be enhanced by quick cooling from a melt, as noted above.

Specially Selected Secondary Soaps

The term "specially selected secondary soaps" herein does not encompass the classic, conventional water-soluble salts of $C_{10}$–$C_{18}$ linear saturated and unsaturated fatty acids, since these classic soaps tend to reduce sudsing. In the practice of this invention, i.e., for high sudsing compositions such as dishwashing liquids, the specially selected soaps, as defined hereinafter, are much preferred. Compositions according to the present invention containing the aforesaid N-alkoxy- polyhydroxy fatty acid amides and such water-soluble special soaps exhibit quite low interfacial tensions, good grease removal properties and, importantly, high sudsing, even at pH's near neutrality, i.e., in the range of ca. 6.5– 9.0. As a general proposition, the improved qualities of the compositions herein appear to peak with such special soaps which are about $C_{12}$, and decrease somewhat with special soaps which contain more than about 13 carbon atoms or less than about 11 carbon atoms, especially with respect to sudsing and even, in some instances, spontaneous emulsification of greasy soils. Accordingly, the $C_{12}$ special soaps are preferred herein. (The aforesaid C numbers are intended to include the carboxylate carbon atom in the special soaps.) These soaps can be employed in any water-soluble salt form, e.g., alkali metal, alkaline earth metals ammonium, alkanolammonium, dialkanol ammonium, trialkanol ammonium, 1–5 carbon alkyl substituted ammonium, basic amino acid groups, and the like; all of these counterions are well-known to manufacturers. The sodium salt form is convenient, cheap and effective. The acid form can also be used, but will usually be converted into the ionic form by pH adjustments which are made during processing of the compositions. Since water-soluble soaps are generally easier to work with, it is preferred that they be used, rather than the fatty acid form.

The specially selected secondary soaps (aka "alkyl carboxyl surfactants") employed herein to provide low interfacial tension, spontaneous emulsification of grease and yet allow for reasonably high sudsing are those which contain a carboxyl unit connected to a secondary carbon. It is to be understood herein that the secondary carbon can be in a ring structure, e.g., as in p-octyl benzoic acid, or as in alkyl-substituted cyclohexyl carboxylates. The special soaps should contain no ether linkages, no ester linkages and no hydroxyl groups. There should be no nitrogen atoms in the head-group (amphiphilic portion). The special soaps usually contain 11– 13 total carbon atoms, although slightly more (e.g., about 14–16) can be tolerated if the soap contains a ring structure, as noted above, e.g., p-octyl benzoic acid.

For purposes of illustration, and not by way of limitation, the special soaps based on the following secondary fatty acids produce low interfacial tension and spontaneous emulsification when used in the manner of this invention: 2-methyl-1-undecanoic acid; 2-ethyl-1-decanoic acid; 2-propyl-1-nonanoic acid; 2-butyl-1-octanoic acid; 2-pentyl-1-heptanoic acid; 2-methyldodecanoic acid; p-octyl benzoic acid; and trans-4-pentylcyclohexane carboxylic acid. By contrast, and to illustrate the importance of a-carbon substitution, chain length, and the like, the following carboxyls do not provide the desirable spontaneous emulsification effect herein: 3-methyl undecanoic acid; p-nonyloxy benzoic acid; 2-hexyl decanoic acid; 12-hydroxy dodecanoic acid; and 2-hydroxy lauric acid.

The following general structures further illustrate some of the special soaps (or their precursor acids) employed in this invention.

A. A highly preferred class of soaps used herein comprises the secondary carboxyl materials of the formula $R^3CH(R^4)COOM$, wherein $R^3$ is $CH_3(CH_2)_x$ and $R^4$ is $CH_3(CH_2)_y$, with $R^3$ and $R^4$ being hydrocarbyl or hydrocarbylene units such as alkylene and alkenylene moieties with the sum of $R^3$ and $R^4$ being from about 7 to about 16 carbon atoms, especially those secondary carboxyl materials wherein y can be 0 or an integer from 1 to 4, x is an integer from 4 to 10 and the sum of (x+y) is 6–10, preferably 7–9, most preferably 8.

B. Another class of special soaps useful herein comprises those carboxyl compounds wherein the carboxyl substituent is on a ring hydrocarbyl unit, i.e., secondary soaps of the formula $R^5R^6COOM$, wherein $R^5$ is $C_7$–$C_{10}$, preferably $C_8$–$C_9$, alkyl or alkenyl and $R^6$ is a ring structure, such as benzene, cyclopentane, cyclohexane, and the like. (Note: $R^5$ can be in the ortho, meta or para position relative to the carboxyl on the ring.)

C. Still another class of soaps comprises secondary carboxyl compounds of the formula $CH_3(CHR^7)_k$—$(CH_2)_m$—$(CHR^7)_n$—CH(COOM)— $(CHR^7)_o$—$(CH_2)_p$—$(CHR^7)_q$—$CH_3$, wherein each $R^7$ is $C_1$–$C_4$ alkyl, wherein k, n, o, q are integers in the range of 0–2 and m and p are integers in the range of 0–8, provided that the total number of carbon atoms (including the carboxylate) is in the range of 10 to 18.

In each of the above formulas A, B and C, the species M can be any suitable, especially water-solubilizing, counterion, e.g., H, alkali metal, alkaline earth metal, ammonium, alkanolammonium, di- and tri- alkanolammonium, $C_1$–$C_5$ alkyl substituted ammonium and the like. Sodium is convenient, as is diethanolammonium.

Preferred secondary soaps for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl- 1-heptanoic acid.

Typical use levels of the aforesaid secondary soaps range from about 1% to about 35%, preferably from about 2% to about 15%, by weight of the compositions herein.

Calcium and Magnesium Source

The preferred compositions herein may also contain from about 0% to about 3%, preferably from about 0% to about 1%, by weight, of calcium ions. High sudsing compositions may contain from about 0% to about 3%, preferably from about 0% to about 1%, by weight of magnesium ions. Sources of calcium and magnesium can be any convenient water-soluble and toxicologically acceptable salt, including but not limited to, $CaCl_2$, $MgCl_2$, $Ca(OH)_2$, $Mg(OH)_2$, $CaBr_2$, $MgBr_2$, $MgSO_4$, $CaSO_4$, Ca formate, Ca malate, Mg malate; Ca maleate, Mg maleate, or the calcium and/or magnesium salts of anionic surfactants or hydrotropes. $CaCl_2$, $MgCl_2$ and mixtures thereof are convenient and preferred herein.

Sudsing

The sudsing qualities of the compositions herein can be tested by any means which mimics realistic in-use situations. For example, the formulator can employ a manual dishwashing test such as the SM-1 Shell test method. This is a practical method which determines the average number of soiled plates which can be manually washed under controlled conditions until the foam collapses.

In a representative type of testing, dinner plates are soiled with mixed foodstuffs. Each plate is then washed separately in an aqueous bath containing the compositions of the present invention, using a controlled number of agitations per plate. The number of plates so washed are counted until the suds have substantially disappeared.

A comparison of the number of plates washed with a control test using any desired hand dishwashing composition can be made to assess the equivalency of sudsing.

In this type of testing, the suds properties of the present compositions will typically be judged to be up to about 80–90% equivalent to those of high-sudsing, commercial hand dishwashing detergents. By contrast, compositions using straight-chain fatty acids such as lauric acid will typically have sudsing levels only about 30%– 40% that of such commercial detergents. As noted hereinafter, if additional suds boosters are added to the present compositions, sudsing levels as high as 90%–100% that of even premium commercial liquid dishwashing detergents may be achieved.

Interfacial Tension

By "interfacial tension" ("IFT") herein is meant the tension measured at the oil/water interface. IFT measurements using the spinning drop technique, are disclosed by Cayias, Schechter and Wade, "The Measurement of Low Interfacial Tension via the Spinning Drop Technique", ACS Symposium Series No. 8 (1975) ADSORPTION AT INTERFACES, beginning at page 234. Equipment for running IFT measurements is currently available from W. H. Wade, Depts. of Chemistry and Chemical Engineering, The University of Texas at Austin, Austin, Tex. 78712.

By "low interfacial tension" herein is meant an IFT which is sufficiently low that "spontaneous emulsification", i.e., rapid emulsification with little or no mechanical agitation, can occur. IFT's of about 0.15 dynes/cm, and below, can easily be secured by the present compositions at usage levels of 200–20,000 ppm.

Spontaneous Emulsification

The "spontaneous emulsification" of greasy/oily soils provided by the compositions herein can be simply, but convincingly, demonstrated by admixing a detergent composition in accordance with the invention containing the specially selected soap with water. After dissolution of the detergent, a few drops of oil to which a colored oil-soluble dye has been added are added to the detergent solution. With minimal agitation, the entire system appears to take on the color of the dye, due to the dyed oil having been finely dispersed by the spontaneous emulsification effect. This dispersion remains for a considerable length of time, typically 30 minutes to several hours, even when agitation has stopped. By contrast, with surfactant systems which fail to provide spontaneous emulsification, the dyed oil droplets produced during agitation rapidly coalesce to form one or more relatively large oil globules at the air/water interface.

More specifically, this demonstration of spontaneous emulsification can be run as follows.

A consumer relevant test soil is dyed with 0.5% Oil Red E6N. A 100 ml sample of the detergent composition being tested is prepared at the desired concentration (typically, about 500 ppm) and temperature in water which is "prehardened" to any desired concentration of calcium ions (typically, about 48 ppm), and contained in an 8 oz. capped jar. The sample pH is adjusted to the intended end-use pH (typically in the range of 6.5 to 8) and 0.2 g of the test soil is added. The jar is shaken 4 times and the sample graded. Alternatively, the sample is placed in a beaker and stirred with a stir bar for 15 seconds. The sample is graded as follows:

0=Clear solution with large red oil droplets in it (0.1–5 mm diameter), i.e., no emulsification;

1=Solution has a definite pink appearance with red oil droplets in it (0.1– 1 mm), i.e., slight emulsification;

2=Solution is dark pink with small red droplets in it, i.e., moderate emulsification;

3=Solution is red with small red droplets in it (1–200 μm), i.e., emulsification is substantial;

4=Solution is dark red with little or no visible droplets (<1–50 μm), i.e., emulsification is complete.

Note: The grading can also be done spectrophotometrically (based on light transmittance).

Compositions of the present type can typically achieve grades at the 3–4 level under conventional liquid dishwashing concentrations and temperatures.

Adjunct Ingredients

The compositions herein can optionally include one or more other detergent adjunct materials or other materials for assisting or enhancing cleaning performance, or to modify the aesthetics of the detergent composition (e.g., perfumes, colorants, dyes, etc.). The following are illustrative examples of such adjunct materials.

Adjunct Surfactants

The compositions herein can optionally, and preferably contain various anionic, nonionic, zwitterionic, etc. surfactants. If used, such adjunct surfactants are typically present at levels of from about 5% to about 35% of the compositions.

Nonlimiting examples of optional surfactants useful herein include the conventional $C_{11}$–$C_{18}$ alkyl benzene sulfonates and primary, branched-chain and random alkyl sulfates, the $C_{10}$–$C_{18}$ secondary (2,3) alkyl sulfates of the formulas $CH_3(CH_2)_x(CHOSO_3{-}M^+)CH_3$ and $CH_3(CH_2)_y(CHOSO_3{-}M^+)CH_2CH_3$ wherein x and (y+1) are integers of at least about 7, preferably at least about 9, and M is a water-solubilizing cation, especially sodium, the $C_{10}$–$C_{18}$ alkyl alkoxy sulfates (especially EO 1-5 ethoxy sulfates), $C_{10}$–$C_{18}$ alkyl alkoxy carboxylates (especially the EO 1-5 ethoxycarboxylates), the $C_{10}$–$C_{18}$ alkyl polyglycosides and their corresponding sulfated polyglycosides, $C_{12}$–$C_{18}$ alpha-sulfonated fatty acid esters, $C_{12}$–$C_{18}$ alkyl and alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like. The alkyl alkoxy sulfates (AES) and alkyl alkoxy carboxylates (AEC) are preferred herein. Use of such surfactants in combination with the aforesaid amine oxide and/or betaine or sultaine surfactants is also preferred, depending on the desires of the formulator. Other conventional useful surfactants are listed in standard texts.

Other Ingredients

A wide variety of other ingredients useful in detergent compositions can be included in the compositions herein, including other active ingredients, carriers, hydrotropes, processing aids, dyes or pigments, solvents for liquid formulations, etc. If an additional increment of sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0.1%–2%, to provide additional sudsing.

The liquid detergent compositions herein can contain water and other solvents as carriers. Low molecular weight primary or secondary alcohols exemplified by methanol, ethanol, propanol, and isopropanol are suitable. Monohydric alcohols are preferred for solubilizing surfactants, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH between about 6.8 and about 9.0. Finished products thus are typically formulated at this range. Techniques for controlling pH at recommended usage levels include the use of buffers, alkalis, acids, etc., and are well known to those skilled in the art.

The following are typical, nonlimiting examples which illustrate the compositions and uses of this invention.

EXAMPLE V

A dishwashing composition with high grease removal properties is as follows. Product pH is adjusted to 7.8.

| Ingredient | % (wt.) |
|---|---|
| $C_{12-14}$ N-(3-methoxypropyl) glucamide | 9.0 |
| $C_{12}$ ethoxy (1) sulfate | 12.0 |
| 2-methyl undecanoic acid | 4.5 |
| $C_{12}$ ethoxy (2) carboxylate | 4.5 |
| $C_{12}$ alcohol ethoxylate (4) | 3.0 |
| $C_{12}$ amine oxide | 3.0 |
| Sodium cumene sulfonate | 2.0 |
| Ethanol | 4.0 |
| $Mg^{++}$ (as $MgCl_2$) | 0.2 |
| $Ca^{++}$ (as $CaCl_2$) | 0.4 |
| Water | Balance |

EXAMPLE VI

The composition of Example V is provided in the form of a gel (by the addition of conventional acrylate and urea gellants), which is useful in dishwashing operations of the type which are conducted in those geographies where gel products are preferred, e.g., Turkey and some South American countries.

EXAMPLE VII

Another example of a light duty liquid especially suitable for dishwashing is as follows; formulation pH 7.8.

| Ingredient | % (wt.) |
|---|---|
| $C_{12}$ N-(3-methoxypropyl) glucamide[1] | 9.0 |
| 2-methyl-1-undecanoate | 4.0 |
| $C_{12-13}$ dimethyl amine oxide[2] | 3.0 |
| $C_{12-13}$ EO(3) sulfate | 11.0 |

-continued

| Ingredient | % (wt.) |
|---|---|
| $C_{12-14}$ AP sultaine[3] | 1.0 |
| $C_{12-14}$ AP betaine[4] | 2.0 |
| $Ca^{++}$ (as $CaCl_2$) | 0.5 |
| $Mg^{++}$ (as $MgCl_2$) | 0.5 |
| Water and ethanol | Balance |

[1]Prepared as disclosed in Example IV.
[2]Acidified with HCl plus ).2% $H_2O_2$ to remove nitrite.
[3]$C_{12/14}H_{25/29}CONH(CH_2)_3N^+(CH_3)_2CH_2CHOHCH_2SO_3^-$.
[4]$C_{12/14}H_{25/29}CONH(CH_2)_3N^+(CH_3)_2CH_2CO_2^-$.

While the foregoing illustrates the present invention and its use in dishwashing compositions, it is not intended to limit the scope of the invention. Indeed, the invention herein can be used in any detergent composition where high sudsing and good grease/oil removal are desired. Thus, the invention herein can be used with various conventional ingredients to provide fully-formulated fabric laundering compositions, hard-surface cleansers, personal cleaning products and the like. Such compositions can be in the form of liquids, granules, bars and the like. The high solubility of the N-alkoxy and N-aryloxy polyhydroxy fatty acid amides even allows such compositions to be formulated as modern "concentrated" detergents which contain as much as 30%–60% by weight of suffactants.

Thus, the formulator may wish to employ various builders, typically at levels from 5% to 50% by weight, in compositions designed for fabric laundering. Typical builders include the 1-10 micron zeolites, polycarboxylates such as titrate and oxydisuccinates, layered silicates, phosphates, and the like. Other conventional builders are listed in standard formularies.

Likewise, the formulator may wish to employ various enzymes, such as cellulases, lipases, amylases and proteases in such compositions, typically at levels of from 0.001%–1% by weight. Various detersive and fabric care enzymes are well-known in the laundry detergent art.

Various bleaching compounds, such as the percarbonates, perborates, and the like, can be used in such compositions, typically at levels from 1%–30% by weight. If desired, such compositions can also contain bleach activators such as tetraacetyl ethylenediamine, nonanoyloxybenzene sulfonate, and the like, which are also known in the art. Usage levels typically range from 1%–15% by weight.

Various soil release agents, especially of the anionic oligoester type, various chelating agents, especially the aminophosphonates and ethylenediaminedisuccinates, various clay soil removal agents, especially ethoxylated tetraethylene pentamine, various dispersing agents, especially polyacrylates and polyaspartates, various brighteners, especially anionic brighteners, various fabric softeners, especially smectite clays, various dye transfer inhibitors such as polyamine N-oxides, polyvinyl pyrrolidones and copolymers of N-vinylpyrrolidone with N-vinylimidazole, and the like can all be used in such compositions at levels ranging from 1%–35% by weight. Standard formularies and published patents contain multiple, detailed descriptions of such conventional materials.

EXAMPLE VIII

A liquid laundry detergent composition herein comprises the following.

| Ingredient | % (wt.) |
|---|---|
| $C_{12-14}$ alkyl sulfate, Na | 10.0 |
| $C_{12-14}$—N-(3-methoxypropyl) glucamide | 10.0 |
| 2-butyl octanoic acid | 5.0 |
| Sodium citrate | 1.0 |
| $C_{10}$ alcohol ethoxylate (3) | 13.0 |
| Monoethanolamine | 2.5 |
| Water/propylene glycol/ethanol (100:1:1) | Balance |

EXAMPLE IX

A granular laundry detergent herein comprises the following.

| Ingredient | % (wt.) |
|---|---|
| $C_{12}$ alkyl benzene sulfonate | 12.0 |
| $C_{12-14}$—N-(2-methoxyethyl) glucamide | 12.0 |
| Zeolite A (1–10 micrometer) | 26.0 |
| 2-butyl octanoic acid | 4.0 |
| $C_{12-14}$ secondary (2,3) alkyl sulfate, Na salt | 5.0 |
| Sodium citrate | 5.0 |
| Sodium carbonate | 20.0 |
| Optical brightener | 0.1 |
| Detersive enzyme* | 1.0 |
| Sodium sulfate | 5.0 |
| Water and minors | Balance |

*Lipolytic enzyme preparation (LIPOLASE).

EXAMPLE X

The compositions of Example VIII and IX are modified by including 0.5% of a commercial proteolytic enzyme preparation (ESPERASE) therein. Optionally, 0.5% of a commercial amylase preparation (TERMAMYL), together with 0.5% of a commercial lipolytic enzyme preparation (LIPOLASE) can be co-incorporated in such liquid and granular detergent compositions.

EXAMPLE XI

A shampoo composition is prepared according to Example VII by deleting the magnesium ions.

EXAMPLE XII

The granular fabric laundry composition of Example IX is modified by the addition of a bleaching amount of a mixture of sodium percarbonate (300–600 micron), or sodium perborate monohydrate, and a bleach activator such as NOBS and TAED to provide a fabric bleaching function.

EXAMPLE XIII

A laundry bar suitable for hand-washing soiled fabrics is prepared by standard extrusion processes and comprises the following:

| Ingredient | % (wt.) |
|---|---|
| $C_{12-16}$ alkyl sulfate, Na | 20 |
| $C_{12}$–$C_{14}$N-(3-methoxypropyl)glucamide* | 5 |
| 2-methyl-1-undecanoic acid, $NH_4$ salt | 5 |
| $C_{11-13}$ alkyl benzene sulfonate, Na | 10 |
| Sodium tripolyphosphate | 7 |
| Sodium pyrophosphate | 7 |
| Sodium carbonate | 25 |
| Zeolite A (0.1–10m) | 5 |
| Coconut monoethanolamide | 2 |

-continued

| Ingredient | % (wt.) |
|---|---|
| Carboxymethylcellulose | 0.2 |
| Polyacrylate (m.w. 1400) | 0.2 |
| Brightener, perfume | 0.2 |
| Protease | 0.3 |
| CAREZYME (Cellulase) | 0.3 |
| $CaSO_4$ | 1 |
| $MgSO_4$ | 1 |
| Water | 4 |
| Filler** | Balance |

*Prepared from mixed coconut fraction fatty acids.
**Can be selected from convenient materials such as $CaCO_3$, talc, clay, silicates, and the like.

What is claimed is:

1. A detergent with high sudsing characteristics, comprising:

(a) at least about 1% by weight of an amide nonionic surfactant of the formula

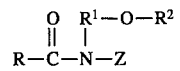

wherein R is a $C_7$–$C_{17}$ hydrocarbyl moiety, $R^1$ is a $C_2$–$C_4$ hydrocarbyl moiety, $R^2$ is a $C_1$–$C_3$ hydrocarbyl or oxy-hydrocarbyl moiety, and Z is a polyhydroxy hydrocarbyl unit having a linear chain with at least two hydroxyls directly connected to the chain; and (b) at least about 1% by weight of a secondary soap.

2. A composition according to claim 1 wherein substituent Z of nonionic surfactant (a) is derived from a reducing sugar.

3. A composition according to claim 2 wherein Z is derived from a reducing sugar which is a member selected from the group consisting of glucose, fructose, maltose, galactose, mannose, xylose and mixtures thereof.

4. A composition according to claim 1 wherein $R^1$ is ethylene or propylene and $R^2$ is methyl.

5. A composition according to claim 4 wherein $R^1$ is ethylene, $R^2$ is methyl, and Z is derived from glucose.

6. A composition according to claim 1 wherein said secondary soap (b) is a member selected from the group consisting of secondary carboxyl materials of the formulae:

(i) $R^3CH(R^4)COOM$, wherein $R^3$ and $R^4$ are each hydrocarbyl or hydrocarbylene units with the sum of $R^3$ and $R^4$ being in the range from about 7 to about 16 carbon atoms and M is H or a water solubilizing cation;

(ii) $R^5R^6COOM$ wherein $R^5$ is $C_7$–$C_{10}$ alkyl or alkenyl, $R^6$ is a hydrocarbyl ring structure and M is H or a water-solubilizing cation; and (iii) $CH_3(CHR^7)_k$—$(CH_2)_m$—$(CHR_7)_n$—CH(COOM)—$(CHR^7)_o$— $(CH_2)_p$— $(CHR^7)_q$—$CH_3$ wherein each $R^7$ is $C_1$–$C_4$ alkyl, wherein k, n, o, and q are integers in the range of 0–2 and m and p are integers in the range of 0.8, and wherein the total number of carbon atoms is about 10 to about 18, and wherein M is H or a water-solubilizing cation.

7. A composition according to claim 6 wherein said secondary soap is a water-soluble salt of a secondary carboxyl material which is a member selected from the group consisting of 2-methyl-1-undecanoic acid, 2-ethyl-1-decanoic acid, 2-propyl- 1-nonanoic acid, 2-butyl-1-octanoic acid, 2-pentyl-1-heptanoic acid, and mixtures thereof.

8. A composition according to claim 1 which additionally comprises at least about 1% by weight of a sulfated or sulfonated anionic surfactant.

9. A composition according to claim 1 which additionally comprises at least about 1% by weight of an additional surfactant which is a member selected from the group consisting of alkoxy carboxylate, amine oxide, betaine and sultaine surfactants, and mixtures thereof.

10. A composition according to claim 1 which additionally comprises at least about 0.05% by weight of calcium ions, magnesium ions, or mixtures thereof.

11. A method for washing dishware or fabrics, comprising contacting said dishware or fabrics with an aqueous medium which contains at least about 100 ppm of a composition according to claim 1.

* * * * *